US011679481B2

(12) United States Patent
Hatamochi

(10) Patent No.: US 11,679,481 B2
(45) Date of Patent: Jun. 20, 2023

(54) BLADE MOUNTING DEVICE FOR MOUNTING BLADE OF PUSHING CUT TOOL

(71) Applicant: JURAKU CO., LTD., Nagoya (JP)

(72) Inventor: Katsumi Hatamochi, Nagoya (JP)

(73) Assignee: JURAKU CO., LTD., Nagoya (JP)

( * ) Notice: Subject to any disclaimer, the term of this patent is extended or adjusted under 35 U.S.C. 154(b) by 128 days.

(21) Appl. No.: 16/960,059

(22) PCT Filed: Dec. 27, 2018

(86) PCT No.: PCT/JP2018/048390
§ 371 (c)(1),
(2) Date: Jul. 3, 2020

(87) PCT Pub. No.: WO2019/035398
PCT Pub. Date: Jul. 11, 2019

(65) Prior Publication Data

US 2021/0053200 A1 Feb. 25, 2021

(30) Foreign Application Priority Data

Jan. 5, 2018 (JP) ..... JP2018-000399

(51) Int. Cl.
*B25D 17/08* (2006.01)
*B25F 1/02* (2006.01)
(Continued)

(52) U.S. Cl.
CPC ..... *B25D 17/08* (2013.01); *B25D 3/00* (2013.01); *B25D 17/02* (2013.01); *B25D 9/04* (2013.01);
(Continued)

(58) Field of Classification Search
CPC ..... B25D 3/00; B25D 17/08; B25D 2222/75; B25D 2250/051; B25F 1/006; B25F 1/02
(Continued)

(56) References Cited

U.S. PATENT DOCUMENTS 841,517 A * 1/1907 Harris ..... B25D 3/00 30/167
843,036 A * 2/1907 Root ..... B25D 3/00 30/167
(Continued)

FOREIGN PATENT DOCUMENTS

FR 2223143 A1 * 3/1973 ..... B25D 17/08
JP S50-127800 U 10/1975
(Continued)

OTHER PUBLICATIONS

An English translation of International Search Report of PCT/JP2018/048390 dated Mar. 19, 2019.

*Primary Examiner* — Thomas M Wittenschlaeger
*Assistant Examiner* — David G Shutty
(74) *Attorney, Agent, or Firm* — Muncy, Geissler, Olds & Lowe, P.C.

(57) ABSTRACT

A blade mounting device allows a blade of a pushing cut tool that cuts a workpiece by pushing a cutting edge forward to be mounted on an impact tool. This blade mounting device has a blade mounting portion for mounting the blade on the blade mounting device and a tool mounting portion secured to the blade mounting portion in order to mount the blade mounting device on the impact tool. The blade mounting portion has a front end portion where an inverted tapered hole complementary to an inclined shape surface formed on a tang of the blade is formed. The tool mounting portion is provided with a through hole perpendicular to the center axis and a center hole that reaches a through hole from a front
(Continued)

side end surface of the tool mounting portion along the center axis.

3 Claims, 10 Drawing Sheets

(51) Int. Cl.
*B25D 3/00* (2006.01)
*B25D 17/02* (2006.01)
*B25D 9/04* (2006.01)

(52) U.S. Cl.
CPC .... *B25D 2222/75* (2013.01); *B25D 2250/051* (2013.01)

(58) Field of Classification Search
USPC ..... 30/167
See application file for complete search history.

(56) References Cited

U.S. PATENT DOCUMENTS 1,268,871 A * 6/1918 Roach ..... B25D 3/00 30/167
1,356,556 A * 10/1920 Payne ..... B25D 11/102 74/56
1,471,461 A * 10/1923 Harmon ..... B25D 3/00 175/425
1,941,289 A * 12/1933 Asline ..... E21B 17/04 403/268
2,487,696 A * 11/1949 Coffing ..... B25F 1/02 403/334
2,507,872 A * 5/1950 Unsinger ..... B25D 3/00 30/280
2,634,775 A * 4/1953 Unsinger ..... B25D 3/00 279/42
3,100,118 A * 8/1963 Terao ..... B25D 17/06 279/19
3,320,986 A * 5/1967 Winston ..... B25D 3/00 30/167
3,377,052 A * 4/1968 Hagen ..... B25D 3/00 254/104
4,466,167 A * 8/1984 Hoffman ..... B25D 9/04 81/463
4,694,912 A * 9/1987 Glaser ..... B44B 3/005 173/121
4,903,784 A * 2/1990 Glaser ..... B44B 3/005 173/121
5,062,749 A * 11/1991 Sheets ..... B23B 31/1071 279/155
5,203,417 A * 4/1993 Glaser ..... B25D 17/06 173/132
8,020,876 B2 * 9/2011 Lin ..... B25D 3/00 279/81
8,141,255 B2 * 3/2012 Su ..... B25D 3/00 173/90
9,079,286 B1 * 7/2015 DeCamillis ..... B25D 17/08
9,975,231 B2 * 5/2018 Jones ..... B25D 3/00
2011/0094353 A1 * 4/2011 Lombardi ..... B25C 3/006 81/438

FOREIGN PATENT DOCUMENTS

JP S52-132392 U 10/1977
JP 3009290 U 4/1995
JP 7-317479 A 12/1995
JP 8-156499 A 6/1996
JP 2012-71393 A 4/2012
JP 2014-43087 A 3/2014

* cited by examiner

BLADE MOUNTING DEVICE FOR MOUNTING BLADE OF PUSHING CUT TOOL

TECHNICAL FIELD

This invention relates to a technique to mount a blade of a pushing cut tool that cut a workpiece by pushing a cutting edge forward on an impact tool.

BACKGROUND ART

When carving is performed, a carving cutter and a chisel cut a wood and the like as a workpiece. When the carving cutter and the chisel as a hand tool is used, however, it is necessary to apply a force to push a cutting edge forward, and therefore, it is not necessarily easy to make a carving. Therefore, as a device to further facilitate carving, various electric carving machines that electrically reciprocate carving knives have been developed (for example, see Patent Document 1) and put on a market.

Patent Document 1: Japanese Unexamined Patent Application Publication No. 8-156499

DISCLOSURE OF THE INVENTION

Problems to be Solved by the Invention

Such an electric carving machine, however, has a small output force to reciprocate the carving cutter, and has an insufficient cutting ability for making large carvings, such as statues of Buddha and decorations for temples and shrines. While there has been known an impact tool using a pneumatic pressure referred to as a breaker or a hammer chisel as a tool that has a large output force of the reciprocation, mounting a carving cutter or a blade of a chisel on such an impact tool causes an application of a strong impact force onto the blade, and therefore, the blade mounted on the impact tool may be deformed.

The present invention has been made to solve the conventional problem described above, and the objective of the present invention is to provide a technique to mount a blade of a pushing cut tool, such as a carving cutter and a chisel, on an impact tool and reduce a deformation of the blade.

Solutions to the Problems

In order to achieve at least a part of the above-described objective, the present invention can be achieved as the following configuration or application example.

[Application Example 1]

A blade mounting device for mounting a blade of a pushing cut tool that cuts a workpiece by pushing a cutting edge forward on an impact tool. The blade mounting device includes a blade mounting portion configured to mount the blade on the blade mounting device, and a tool mounting portion secured to the blade mounting portion and configured to mount the blade mounting device on the impact tool. The blade mounting portion has a front end portion where an inverted tapered hole is formed to be complementary to an inclined shape surface formed on a tang of the blade. The tool mounting portion is provided with a through hole perpendicular to a center axis of the tool mounting portion and a center hole that reaches the through hole from a front side end surface of the tool mounting portion along the center axis. The blade mounting device is configured such that an impact force applied from the impact tool to the blade mounting device is transmitted to the blade via an inner surface of the inverted tapered hole and the inclined shape surface.

According to this application example, the impact force applied to the blade mounting device is transmitted to the blade via the inclined shape surface formed in the tang of the blade and the inner surface of the inverted tapered hole that is complementary to the inclined shape surface and provided on the blade mounting portion. The inclined shape surface and the inner surface of the inverted tapered hole that transmit this impact force and are complementary to one another are easy to enlarge their sizes, thereby ensuring further enlarging a transmission surface of the impact force to reduce a deformation of the blade caused by the impact force.

Furthermore, the tool mounting portion mounted on the blade mounting portion is provided with the through hole perpendicular to the center axis of the tool mounting portion and the center hole that reaches the through hole from the front side end surface of the tool mounting portion along the center axis. Therefore, the air can be supplied through these through hole and center hole, thereby ensuring a reduced temperature rise in a region where the impact force is transmitted by cooling with the supplied air.

[Application Example 2]

The blade mounting device according to Application Example 1 in which the inclined shape surface and the inverted tapered hole have an inclined angle set to be in a range of 4 to 6°.

According to this application example, the blade is restricted from dropping off of the blade mounting device, and the removal of the blade from the blade mounting device can be facilitated.

[Application Example 3]

The blade mounting device according to Application Example 1 or 2, in which a combination of two members securely mounted on one another to transmit an impact force in the blade mounting device is secured by meshing complementarily tapered surfaces.

According to this application example, the combination of the two members to transmit the impact force is secured by meshing the complementarily tapered surfaces, thereby ensuring a reduced damage at the securing portion caused by the impact force.

[Application Example 4]

The blade mounting device according to any one of Application Examples 1 to 3, in which the blade mounting device is configured to mount a blade of a chisel as the blade. The blade mounting portion includes a blade holder and a tightening ring. The blade holder has a male thread portion and a tapered portion provided in a front side of the male thread portion. The tapered portion has an outer surface formed into a tapered shape. The blade holder is provided with the inverted tapered hole and a slit that reaches the male thread portion from a front side end surface. The tightening ring is provided with a female screw that meshes with the male thread portion. The tightening ring being provided with a tightening inverted tapered hole complementary to the tapered portion in a front side of the female screw.

According to this application example, a distal end of the slit can be opened and closed by rotating the tightening ring, thereby ensuring restricting the blade from dropping off of the blade mounting device and solving the blade from being securely mounted to the blade mounting device with more certainty.

[Application Example 5]

The blade mounting device according to any one of Application Examples 1 to 3. The blade mounting device further includes a knocker including a knocker main body and a spring. The knocker is configured to allow hammering the tang forward. The blade mounting device is configured to mount a blade of a chisel as the blade. The blade mounting portion is provided with a knocker housing hole that houses the spring and the knocker main body in this order along the center axis of the blade mounting portion, and an air discharge hole and an air vent hole perpendicular to the center axis to reach the knocker housing hole from an outer surface of the blade mounting portion. The blade mounting portion is provided with the inverted tapered hole in a front side of the knocker housing hole. The knocker housing hole has an inner diameter set to be larger than an inner diameter of a side end of the knocker housing hole of the inverted tapered hole. The knocker main body has a large diameter portion set to have an outer diameter identical to the inner diameter of the knocker housing hole and a small diameter portion disposed in a front side of the large diameter portion. The small diameter portion has an outer diameter smaller than an inner diameter of the spring. The air discharge hole is provided such that the large diameter portion is positioned in a front with respect to the air discharge hole when the spring is brought into contact with both the knocker housing hole and the large diameter portion in a natural length. The air vent hole is provided in a front with respect to the air discharge hole.

According to this application example, covering the air discharge hole ensures moving the knocker forward and applying a forward impact from the knocker to the tang. Therefore, loosening the security between the tang and the inverted tapered hole ensures further facilitating to remove the blade from the blade mounting device.

[Application Example 6]

The blade mounting device according to any one of Application Examples 1 to 3. The blade includes a carving cutter replaceable blade. The blade mounting portion includes a tightening ring and a blade holder. The tightening ring is provided with a female screw. The tightening ring is provided with the inverted tapered hole in a front side of the female screw. The blade holder has a male thread portion provided with a male screw that meshes with the female screw, a tapered portion disposed in a front side of the male thread portion and is formed into a tapered shape complementary to the inverted tapered hole, and a projecting portion disposed in a front side of the tapered portion. The blade holder is provided with a slit that reaches the male thread portion from a front side end surface. The slit has a width set to have a width identical to a thickness of the tang of the blade.

According to this application example, the carving cutter replaceable blade can be sandwiched by the inner surface of the slit, thereby ensuring restricting the carving cutter replaceable blade from dropping off with more certainty. Disposing the projecting portion in the front side of the tapered portion in the blade mounting portion ensures the projecting portion engaging with the blade of the carving cutter replaceable blade. Therefore, even with a carving cutter replaceable blade having a tang with a narrow width, it is possible to reduce bending of the carving cutter replaceable blade in the tang of the carving cutter replaceable blade or a breakage of the carving cutter replaceable blade in the front side of the tang.

[Application Example 7]

A blade of a chisel mounted on the blade mounting device according to any one of Application Examples 1 to 5. The tang is formed into a tapered shape complementary to the inverted tapered hole.

According to this application example, the tang is formed into a tapered shape complementary to the inverted tapered hole provided in the blade mounting portion of the blade mounting device, thereby ensuring the blade being mounted on the blade mounting device in a further appropriate state.

[Application Example 8]

A chisel that uses the blade of the chisel according to Application Example 7. The chisel includes a handle and a ferrule configured to mount the blade on the handle. The ferrule is provided with an inverted tapered hole complementary to the tang. The ferrule and the handle are provided with a through hole perpendicular to a center axis of the ferrule and the handle at a position in a distal end portion of the tang in a state where the blade, the ferrule, and the handle are secured.

According to this application example, a blade of a chisel mounted on the impact tool via the blade mounting device and a blade of a chisel as a hand tool can be shared. Therefore, a sharp blade used in a chisel can be used by mounting on the impact tool without separately preparing the blade mounted on the impact tool.

[Application Example 9]

A carving cutter replaceable blade mounted on the blade mounting device according to any one of Application Example 1 to 3 and 6. The tang has a side surface formed into an inclined shape complementary to the inverted tapered hole.

According to this application example, the side surface of the tang is formed into the inclined shape complementary to the inverted tapered hole provided in the blade mounting portion of the blade mounting device, thereby ensuring mounting the carving cutter replaceable blade on the mounting device in a further appropriate state.

[Application Example 10]

An adapter for mounting a carving cutter replaceable blade on the blade mounting device according to any one of Application Examples 1 to 3 and 6. The adapter is set to have a thickness identical to a thickness of a tang of the carving cutter replaceable blade. The adapter has a side surface configured to be a plate-shaped member formed into a tapered shape complementary to the inverted tapered hole. The adapter has a front side where a depressed portion complementary to the tang of the carving cutter replaceable blade is formed.

According to this application example, even with the carving cutter replaceable blade whose shape of the tang is not appropriate for mounting on the blade mounting device, using the adapter whose side surface is formed into an inclined shape complementary to the inverted tapered hole provided in the blade mounting device of the blade mounting portion ensures mounting the carving cutter replaceable blade on the blade mounting device in a further appropriate state.

DESCRIPTION OF PREFERRED EMBODIMENTS

The following describes configurations for executing the present invention in the following order.

A. First Embodiment:

A1. Configuration of Blade Mounting Device:

A2. Mounting Blade of Chisel on Blade Mounting Device:

A3. Mounting Blade Mounting Device on Impact Tool:

A4. Configuration of Chisel as Hand Tool:

B. Second Embodiment:

C. Third Embodiment:

D. Fourth Embodiment:

E. Modification:

A. First Embodiment

Figure 1:
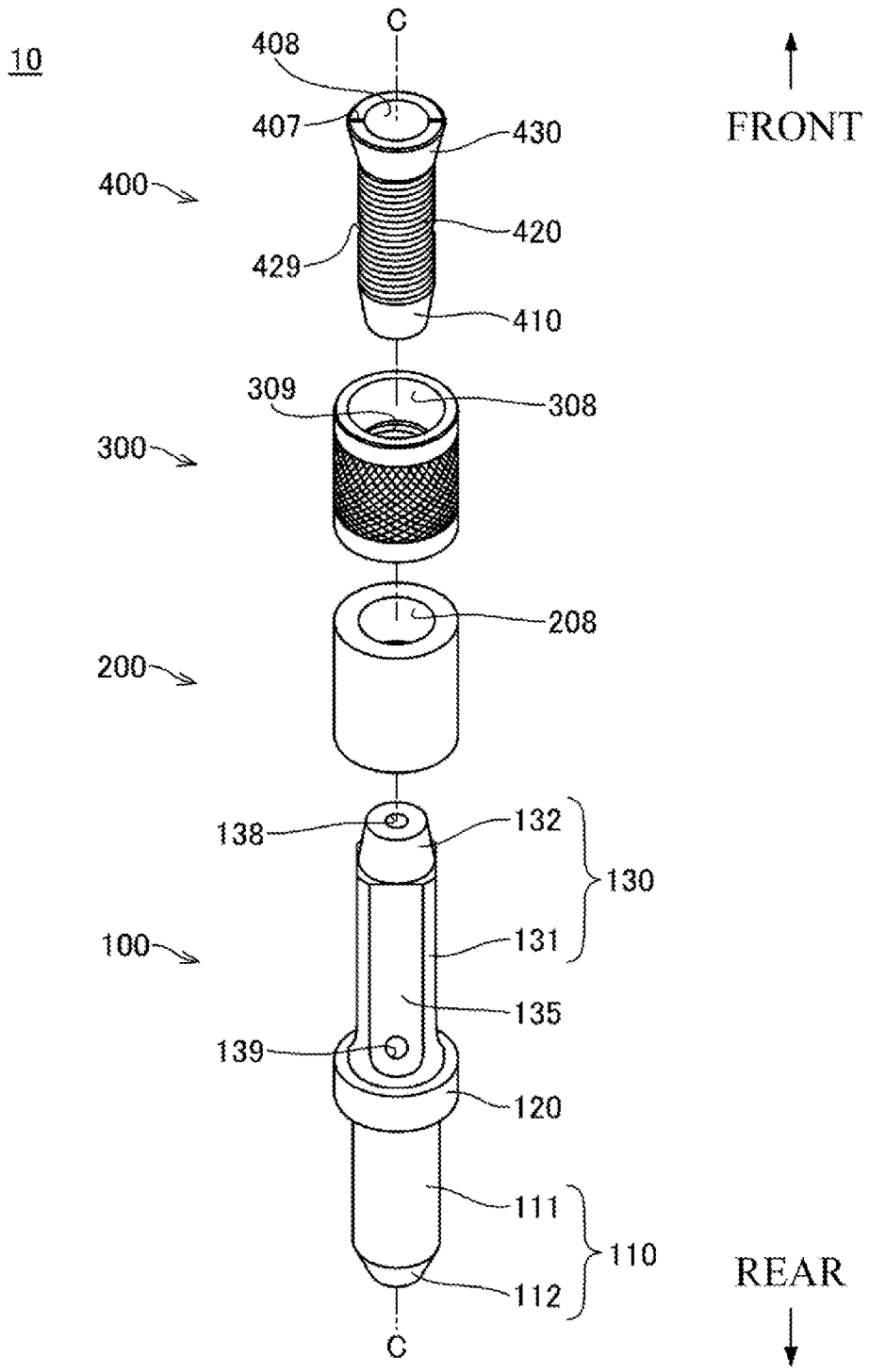
FIG. 1 is an exploded perspective view illustrating a configuration of a blade mounting device according to a first embodiment.

A1. Configuration of Blade Mounting Device:

FIG. 1 is an exploded perspective view illustrating a configuration of a blade mounting device 10 according to a first embodiment of the present invention. The blade mounting device 10 of the first embodiment is a device for mounting a blade of a chisel on an impact tool, such as a breaker. Note that, a specific mounting aspect of the blade on the blade mounting device 10 and a specific mounting aspect of the blade mounting device 10 on the impact tool are described later.

The blade is mounted from a front side and the blade mounting device 10 is mounted on the impact tool at a rear side. Note that, in this description and the present invention, "forward" or "front" means a direction from the impact tool to the blade, and "rearward" or "rear" means a direction opposite to forward, that is, a direction from the blade to the impact tool in this way. The chisel is a tool that cuts a workpiece by pushing a cutting edge formed on the blade forward, and therefore, can be referred to as a "pushing cut tool." Therefore, the blade mounted on the blade mounting device 10 in the first embodiment can also be referred to as a blade of the pushing cut tool.

As illustrated in FIG. 1, the blade mounting device 10 includes a tool mounting portion 100, a holder coupling portion 200, a tightening ring 300, and a blade holder 400. The blade mounting device 10 is formed by attaching each of these portions 100, 200, 300, and 400 along a center axis C indicated by a one dot chain line in this order. Note that this center axis C is a center axis for all the blade, the blade mounting device 10, and the impact tool and is also a center axis for the blade mounting device 10 or each of the portions 100, 200, 300, and 400, which configures the blade mounting device 10.

The tool mounting portion 100 has a base end portion 110 disposed in a rear side, a shaft portion 130 disposed in a front side, and a collar portion 120 disposed between the base end portion 110 and the shaft portion 130. The base end portion 110 is a solid member that has a columnar portion 111 in a column shape and a tapered portion 112 that is disposed in the rear side of the columnar portion 111 and has an outer diameter reducing as approaching the rear. The collar portion 120 is a solid disk-shaped member having an outer diameter larger than those of the base end portion 110 and the shaft portion 130.

The shaft portion 130 has a shaft main portion 131 and a tapered portion 132 in a truncated cone shape (tapered shape) that is disposed in a front side of the shaft main portion 131 and has an outer diameter reducing as approaching the front. The shaft portion 130 has a rear end portion at which a through hole 139 perpendicular to the center axis C is provided. In the shaft portion 130, a center hole 138 along the center axis C is also provided so as to reach the through hole 139 from the front side end surface.

The shaft main portion 131 has four plane surface portions 135 parallel to the center axis C formed in order to restrict the tool mounting portion 100 (the blade mounting device 10) from rotating about the center axis C. Therefore, the shaft main portion 131 has an outer shape roughly in a shape of a column that is cut at four planar surfaces. Note that, it is possible to omit the formation of the plane surface portion 135 in case that the rotation of the tool mounting portion 100 (the blade mounting device 10) about the center axis C can be restricted by, for example, a configuration of the impact tool.

The holder coupling portion 200 is an approximately cylindrically-shaped member. The holder coupling portion 200 has a rear side where a rear side inverted tapered hole (not illustrated) having an inner diameter that enlarges as approaching the rear is formed, and has a front side where a front side inverted tapered hole 208 having an inner diameter that enlarges as approaching the front is formed. These inverted tapered holes communicate with a center axis C direction in the center of the holder coupling portion 200.

The rear side inverted tapered hole formed in the rear side of the holder coupling portion 200 and the tapered portion 132 of the tool mounting portion 100 (the shaft portion 130) are set to have approximately the same taper angles and diameters at the rear end. This causes the tapered portion 132 of the tool mounting portion 100 to mesh with the rear side inverted tapered hole of the holder coupling portion 200, thereby securing the holder coupling portion 200 and the tool mounting portion 100. Here, the taper angle refers to an angle formed by a surface of the tapered portion or the inverted tapered hole and the center axis C on a planar surface that passes the tapered portion or the inverted tapered hole through the center axis C. Note that, as is clear from this, the inverted tapered hole and the tapered portion that meshes with the inverted tapered hole have inclined shapes that incline with respect to the center axis C, and the inverted tapered hole and the tapered portion have shapes that complement one another.

The tightening ring 300 is an approximately cylindrically-shaped member. The tightening ring 300 has a rear side where a female screw 309 is formed. This female screw 309 has a front side where an inverted tapered hole 308 having an inner diameter that enlarges as approaching the front is formed.

The blade holder 400 has a rear side tapered portion 410 that is disposed in the rear side and has an outer diameter reducing as approaching the rear, a male thread portion 420 that is disposed in a front side of the rear side tapered portion 410 and has a male screw, and a front side tapered portion 430 that is disposed in a front side of the male thread portion 420 and has an outer diameter enlarging as approaching the front.

The blade holder 400 has a center hole (not illustrated) along the center axis C provided in the rear side and an inverted tapered hole 408 having an inner diameter that enlarges as approaching the front provided in the front side of the center hole. In the male thread portion 420 of the blade holder 400, a through hole 429 perpendicular to the center axis C is provided. In the blade holder 400, a slit 407 is provided so as to reach from the front side end surface to the through hole 429. Note that, the through hole 429 can be omitted. However, providing the through hole 429 reduces a concentration of stress when the blade holder 400 is deformed as described later, thereby ensuring reduced possibility of generation of crack and the like when the deformation of the blade holder 400 is repeated.

The rear side tapered portion 410 and the front side inverted tapered hole 208 of the holder coupling portion 200 are set to have approximately the same taper angles and diameters at the front end. This causes the rear side tapered portion 410 of the blade holder 400 to mesh with the front side inverted tapered hole 208 of the holder coupling portion 200, thereby securing the blade holder 400 to the holder coupling portion 200.

The male screw formed in the male thread portion 420 of the blade holder 400 is formed to mesh with the female screw 309 formed in the tightening ring 300. Therefore, rotating the tightening ring 300 enables the tightening ring 300 to move back and forth along the center axis C.

The front side tapered portion 430 of the blade holder 400 and the inverted tapered hole 308 provided in the tightening ring 300 are set to have approximately the same taper angles. In contrast to this, the diameters at the front ends are set such that the front side tapered portion 430 of the blade holder 400 is larger than the inverted tapered hole 308 provided in the tightening ring 300. Therefore, rotating the tightening ring 300 to move the tightening ring 300 forward ensures deforming the blade holder 400 such that a front end of the slit 407 closes.

Thus, moving the tightening ring 300 forward closes the front end of the slit 407, thereby ensuring a reduced interference of the tightening ring with the blade when the blade is removed from the blade mounting device 10 (the blade holder 400) as described later.

Figure 2:
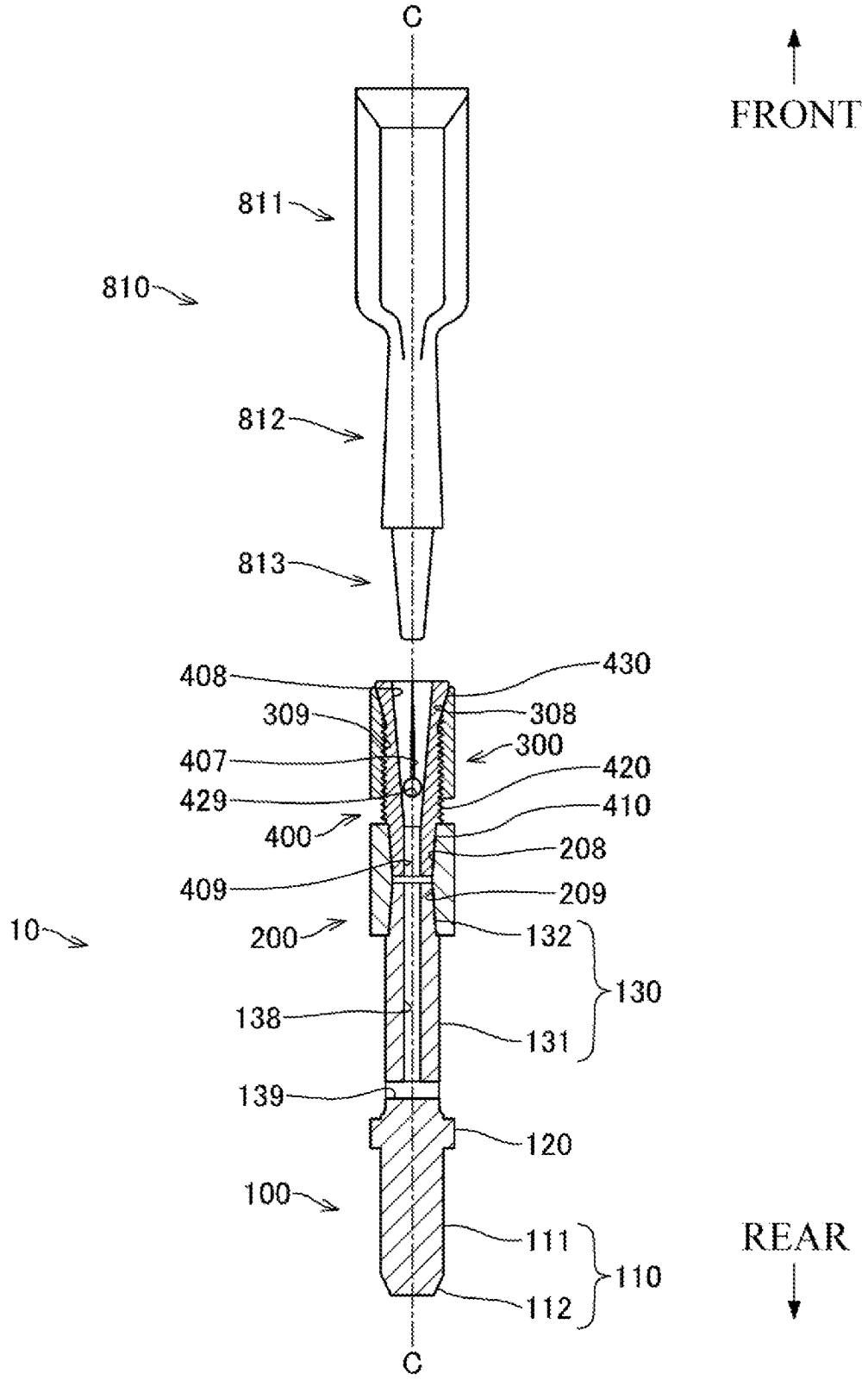
FIG. 2 is an explanatory drawing illustrating a state where a blade of a chisel is being mounted on the blade mounting device.

A2. Mounting Blade of Chisel on Blade Mounting Device:

FIG. 2 is an explanatory drawing illustrating a state where a blade 810 is being mounted on the blade mounting device 10. In FIG. 2, the blade mounting device 10 is illustrated in a cross section cut off along a planar surface that passes through the center axis C and is perpendicular to the slit 407, and the blade 810 is illustrated in an appearance viewed from the front. Note that, the example in FIG. 2 illustrates a state where the tightening ring 300 of the blade mounting device 10 is rotated to deform the blade holder 400 so as to close the front end of the slit 407 after each of the portions 100, 200, 300, and 400 configuring the blade mounting device 10 are attached. In FIG. 2, since the cross section of the blade mounting device 10 is depicted, a rear side inverted tapered hole 209 provided in the holder coupling portion 200 and a center hole 409 provided in the blade holder 400, which are not illustrated in FIG. 1, are shown.

The blade 810 of the chisel illustrated in FIG. 2 is similar to a blade of a common chisel in that it has a blade 811, a neck 812, and a tang 813. The blade 810 according to the first embodiment, however, the tang 813 is formed into a tapered shape having an outer diameter reducing as approaching the rear. Note that, the tang 813 being formed into the tapered shape is not limited to the case where the whole tang 813 is formed into the tapered shape as illustrated in FIG. 2. In the present invention and this description, the tang being formed into the tapered shape means that the tapered shape is formed over at least ½ or more of the length of the tang from a front end of the tang in a length along the center axis C direction. However, as described later, a region formed into the tapered shape functions so as to transmit an impact force applied by the impact tool, and therefore, the length of the region in the tapered shape is preferred to be ⅔ or more of the length of the tang.

The tang 813 has a taper angle that is set to be approximately the same as taper angle of the inverted tapered hole 408 in the state where the front end of the slit 407 is not closed (see FIG. 1). The forward end of the tang 813 also has an outer diameter that is set to be approximately the same as the inner diameter of the front end of the inverted tapered hole 408 in the state where the front end of the slit 407 is not closed. Therefore, as illustrated in FIG. 2, when the blade holder 400 is deformed so as to close the front end of the slit 407, the tang 813 meshes with the inverted tapered hole 408 in a state where a rear side end surface of the neck 812 is separated from a front side end surface of the blade holder 400. This secures the blade 810 to the blade mounting device 10, and transmits the impact force applied to the blade mounting device 10 from the impact tool to the blade 810 via an inner surface of the inverted tapered hole 408 having the inverted tapered shape and an outer surface of the tang 813 having the tapered shape.

Thus, the impact force applied to the blade mounting device 10 from the impact tool is transmitted to the blade 810 via inclined shaped surfaces (the inner surface of the inverted tapered hole 408 and the outer surface of the tang 813) formed in complementarily tapered shapes (inclined shapes), and these complementarily inclined shaped surfaces are much easier to increase a size compared with the rear side end surfaces of the neck 812 and the tang 813. Therefore, it is much easier to widen a transmission surface of the impact force to reduce the deformation of the blade 810 by the impact force.

In the first embodiment, since impact force is applied to the blade mounting device 10 from the impact tool in the state where the tang 813 meshes with the inverted tapered hole 408, the tang 813 is fixedly secured to the inverted tapered hole 408 during the use. However, rotating the tightening ring 300 to move the tightening ring 300 rearward opens the front end of the slit 407 of the blade holder 400. This releases the tang 813 from being fixedly secured to the inverted tapered hole 408, thereby ensuring a further easy removal of the blade 810 from the blade mounting device 10.

Note that, as the taper angles of the inverted tapered hole 408 of the blade holder 400 and the tang 813 decrease, the blade 810 and the blade holder 400 are strongly secured, however, it becomes difficult to remove the blade 810 from the blade holder 400. On the other hand, while as the taper angles of the inverted tapered hole 408 and the tang 813 increase, it becomes easy to remove the blade 810 from the blade holder 400, the security between the blade 810 of the chisel and the blade holder 400 weakens to cause a possibility of the removal of the blade 810 from the blade holder 400 during the use. The taper angles of the inverted tapered hole 408 and the tang 813 are set taking these aspects into consideration. Specifically, the taper angles of the inverted tapered hole 408 and the tang 813 are preferred to be set to 4 to 6°, and are more preferred to be set to 4.5 to 5.5°.

On the other hand, the tool mounting portion 100 and the holder coupling portion 200, and the holder coupling portion 200 and the blade holder 400 are not required to be frequently disassembled, and therefore, the removal does not necessarily have to be facilitated. Therefore, the taper angles of the tapered portion 132 of the tool mounting portion 100 and the rear side inverted tapered hole 209 of the holder coupling portion 200, and the taper angles of the front side inverted tapered hole 208 of the holder coupling portion 200 and the rear side tapered portion 410 of the blade holder 400 are set to be smaller than the taper angles of the inverted tapered hole 408 of the blade holder 400 and the tang 813. Specifically, these taper angles are preferred to be set to 2 to 6°, and are more preferred to be set to 3 to 5°.

Thus, in the blade mounting device 10 according to the first embodiment, between the two members (that is, the tool mounting portion 100 and the holder coupling portion 200, and the holder coupling portion 200 and the blade holder 400) that are securely mounted to one another and transmit the impact force are secured by meshing the complementarily tapered surface. Therefore, it is possible to reduce the damage of the blade mounting device 10 by the impact force applied from the impact tool compared with the case where screws and the like secure them.

Note that, as can be seen from the description above, the tightening ring 300 and the blade holder 400 are members to achieve a function to mount the blade 810 on the blade mounting device 10. Therefore, the tightening ring 300 and the blade holder 400 can also be collectively referred to as a "blade mounting portion."

Figure 3:
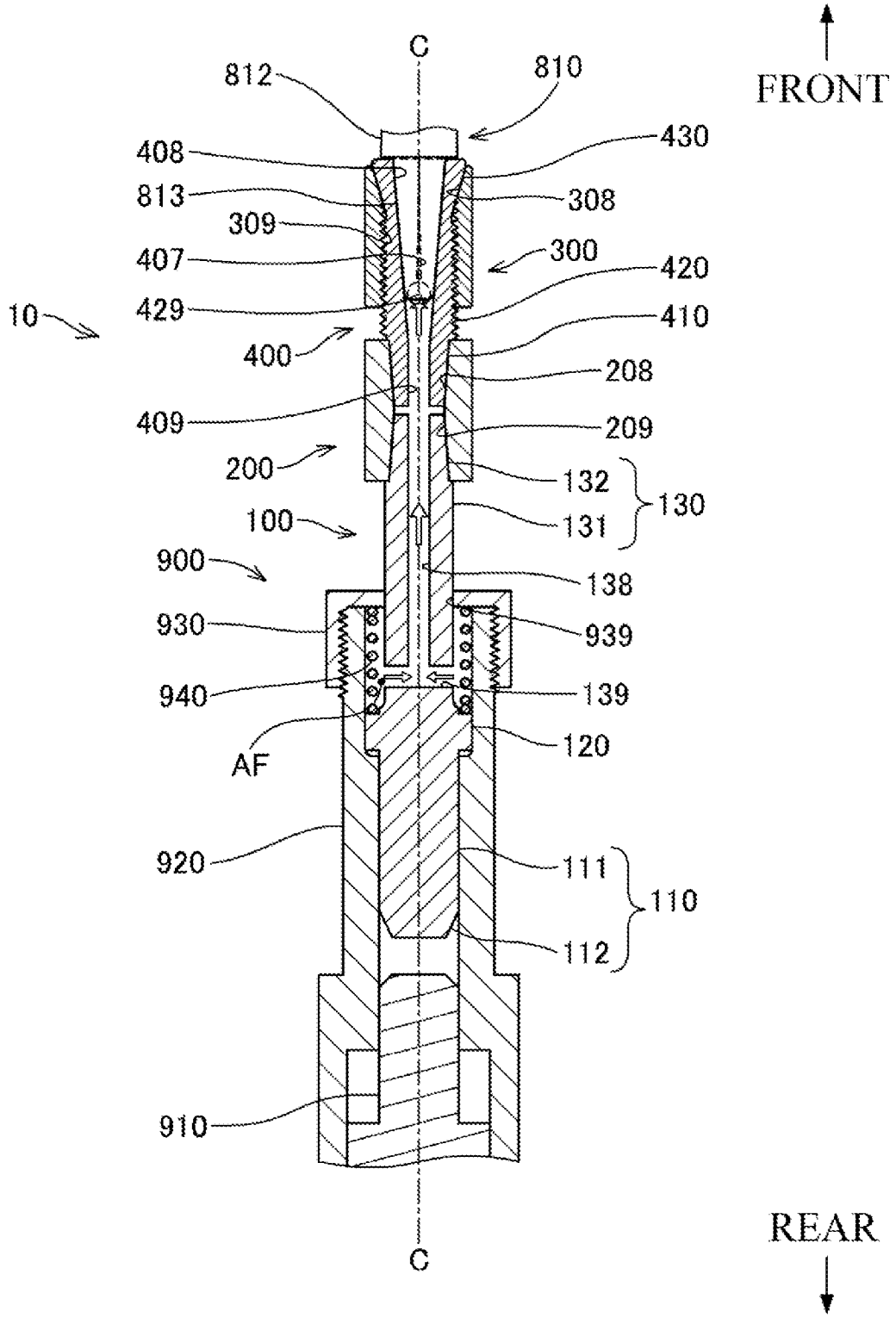
FIG. 3 is an explanatory drawing illustrating a state where the blade mounting device is mounted on an impact tool.

A3. Mounting Blade Mounting Device on Impact Tool:

FIG. 3 is an explanatory drawing illustrating a state where the blade mounting device 10 is mounted on the impact tool 900. FIG. 3 illustrates the state where the blade mounting device 10 is mounted on the impact tool 900, and the blade 810 is mounted on the blade mounting device 10.

As illustrated in FIG. 3, the impact tool 900 includes a piston 910, a cylinder 920, a cap 930, and a spring 940. The cylinder 920 houses the piston 910 and a collar portion and a base end portion disposed in a rear side of a chisel. Here, the chisel is a tool bit generally used in the impact tool 900, and an outer shape of the tool mounting portion 100 of the blade mounting device 10 has a shape similar to that of the rear end portion of the chisel.

The cylinder 920 has a front end portion having an inner diameter enlarged so as to house the collar portion 120 of the tool mounting portion 100 and having an outer surface where a male screw is formed. The cap 930 in a closed-bottomed cylindrical shape has a female screw formed to mesh with this male screw, and screwing the cap 930 secures the cap 930 to the cylinder 920. In the cap 930, a through hole 939 for passing through the shaft portion 130 of the tool mounting portion 100 is provided. The spring 940 is brought into contact with both the collar portion 120 and the cap 930. This biases the tool mounting portion 100 rearward.

Operating the impact tool 900 causes the piston 910 to reciprocate back and forth along the center axis C by an air pressure of a compressed air as its power source. When the piston 910 moves forward, a front end of the piston 910 is brought into contact with the base end portion 110 of the tool mounting portion 100, and thus, the impact force is applied to the tool mounting portion 100. Transmission of this impact force to the blade 810 via the blade mounting device 10 performs cutting by the blade formed on the blade 810.

Note that, while it is not illustrated, in the impact tool 900, a compressed air is usually introduced into a space (front end space) AF formed by the front end portion of the cylinder 920 and the cap 930 in order to restrict dust from invading into the impact tool 900 from a gap between the shaft portion 130 and the through hole 939 provided in the cap 930.

As described above, since the through hole 139 provided in the shaft portion 130 of the tool mounting portion 100 is provided in the rear end portion of the shaft portion 130 near the collar portion 120, when the collar portion 120 is disposed in the front end space AF, the through hole 139 is positioned in the front end space AF. Therefore, the front end space AF of the impact tool 900 is connected to an outside via a flow passage (an air flow passage) formed by this through hole 139, the center hole 138 provided in the shaft portion 130, the inverted tapered holes 209 and 208 provided in the holder coupling portion 200, the center hole 409 provided in the blade holder 400, the inverted tapered hole 408, the through hole 429, and the slit 407. Therefore, the compressed air introduced into the front end space AF is discharged to the outside flowing inside the air flow passage as illustrated with outlined arrows.

In the first embodiment, the blade holder 400 and the blade 810 are secured by meshing the inverted tapered hole 408 with the tang 813, which are formed into complementarily inclined shapes. At this time, if the impact force is applied to a contact portion between the inverted tapered hole 408 and the tang 813, a friction is generated between the inverted tapered hole 408 and the tang 813, thereby increasing the temperature of the blade holder 400 and the tang 813. However, in the first embodiment, since the compressed air flows inside the air flow passage, the blade holder 400 and the tang 813 are cooled down, thereby ensuring a reduced temperature rise of the blade holder 400 and the tang 813. Similarly, in the first embodiment, since the tool mounting portion 100, the holder coupling portion 200, and the blade holder 400 are secured by meshing the complementarily tapered surfaces, the temperature rise on these tapered surfaces can also be restricted.

In the blade mounting device 10 of the first embodiment, the through hole 139 and the center hole 138 that form the air flow passage in the tool mounting portion 100 are provided in the shaft portion 130 in the front side with respect to the collar portion 120. Therefore, the air flow passage that connects to the front end space AF is formed without providing an opening on an end surface in the rear side (an impact tool 900 side) of the tool mounting portion 100, and thus, the base end portion 110 can be made solid. Thus, the base end portion 110 being made solid ensures reducing the deformation of the base end portion 110 caused by an impact force application on the base end portion 110 from the piston 910.

Note that, while in the first embodiment, the air flow passage that communicates between the front end space AF and the slit 407 formed in the blade holder 400 is formed, generally, it is only necessary that the through hole 139 and the center hole 138 that serve as the air flow passage are provided in the shaft portion 130 of the tool mounting portion 100. In this case, a through hole perpendicular to the center axis C may be provided in the male thread portion of the holder coupling portion or the blade holder to discharge the compressed air to the outside from this through hole. Even in this case, since the compressed air is supplied up to a position close to the contact portion between the inverted tapered hole 408 and the tang 813, the temperature rise of the blade holder 400 and the tang 813 can be restricted. However, from the ability of reducing the temperature rise with more certainty, the air flow passage is preferred to be formed to communicate with the slit 407 formed in the blade holder 400.

Figure 4:
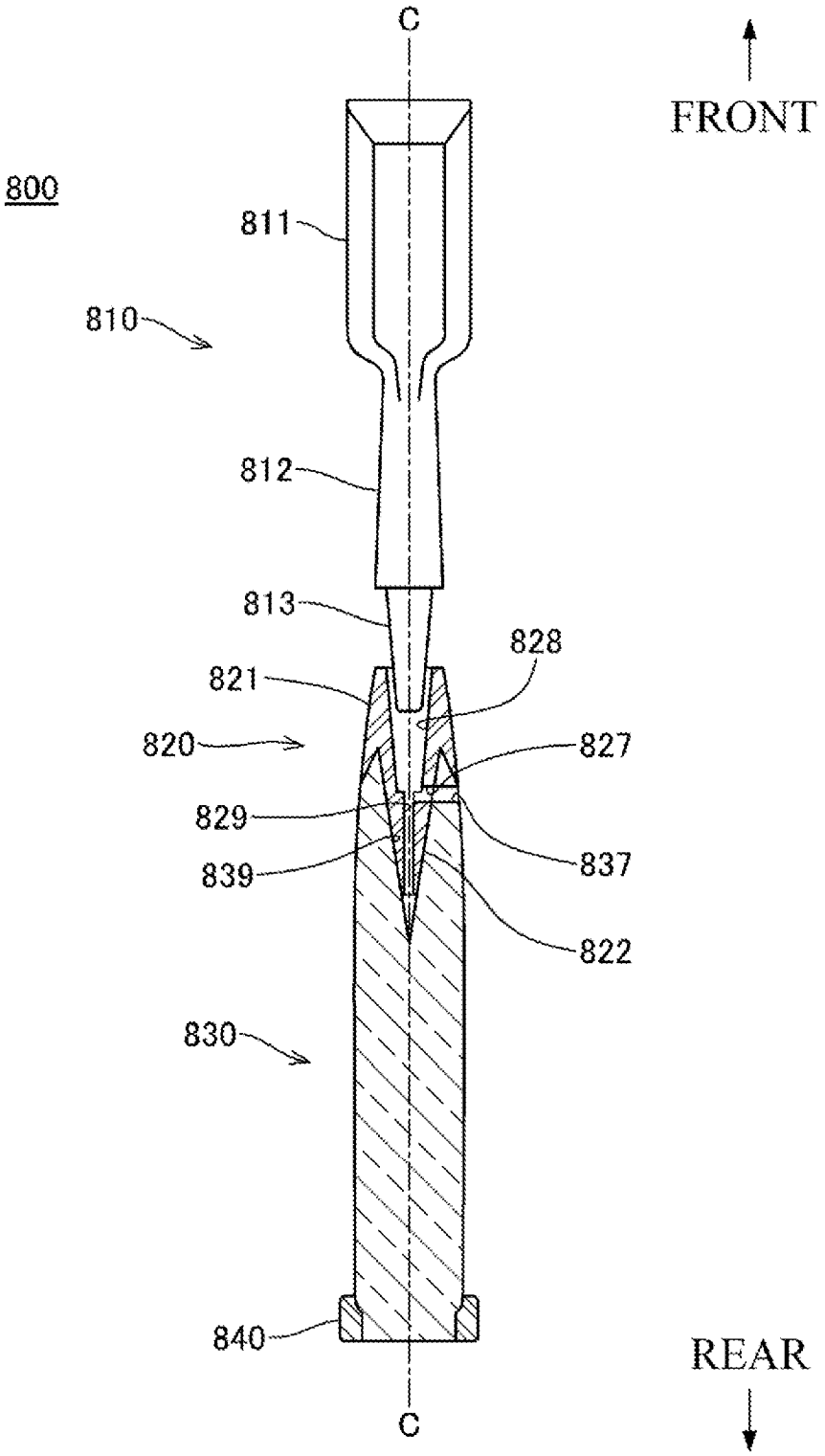
FIG. 4 is an explanatory drawing illustrating a configuration of a chisel using the blade according to the first embodiment.

A4. Configuration of Chisel as Hand Tool:

FIG. 4 is an explanatory drawing illustrating a configuration of a chisel 800 that uses the blade 810 according to the first embodiment. The chisel 800 as a hand tool is configured of the blade 810, a ferrule 820, a handle 830, and a steel hoop 840. Note that the configurations and the functions of the respective portions are approximately similar to those of a common chisel, and therefore, the description shared with the common chisel is omitted.

The ferrule 820 has a ring-shaped portion 821 in an approximately circular ring shape and a tapered portion 822 that extends rearward from the ring-shaped portion 821 and has an outer shape that reduces as approaching the rear. The ferrule 820 is secured to the handle 830 by inserting and meshing this tapered portion 822 into an inverted tapered hole 839 provided in the handle 830.

The ferrule 820 is also provided with a center hole 829 in a rear side similarly to the blade holder 400, and an inverted tapered hole 828 having an inner diameter that enlarges as approaching the front in a front side of the center hole 829. The inverted tapered hole 828 has a taper angle and an inner diameter in the front side that are set to the same as the taper angle of the tang 813 and the outer diameter of the front side. Meshing the tang 813 with the inverted tapered hole 828 secures the blade 810 and the ferrule 820.

The tapered portion 822 of the ferrule 820 and the handle 830 are provided with through holes 827 and 837 perpendicular to the center axis C, respectively. These through holes 827 and 837 are provided to be positioned in a rear end portion of the tang 813 (that is, a distal end portion of the tang 813) in a state where the blade 810, the ferrule 820, and the handle 830 are secured. Applying an impact on the rear end portion of the tang 813 through these through holes 827 and 837 loosens the security between the tang 813 and the tapered portion 822, thereby ensuring easily removing the blade 810 from the ferrule 820.

Thus, using the ferrule 820 provided with the inverted tapered hole 828 in a shape complementary to the tang 813 can make the blade 810 mounted on the impact tool and the blade 810 mounted on the chisel 800 as a common component. Therefore, without separately preparing the blade 810 that can be mounted on the impact tool, the blade 810 that is used for the chisel 800 and is sharp can be mounted and used on the impact tool.

B. Second Embodiment

Figure 5A:
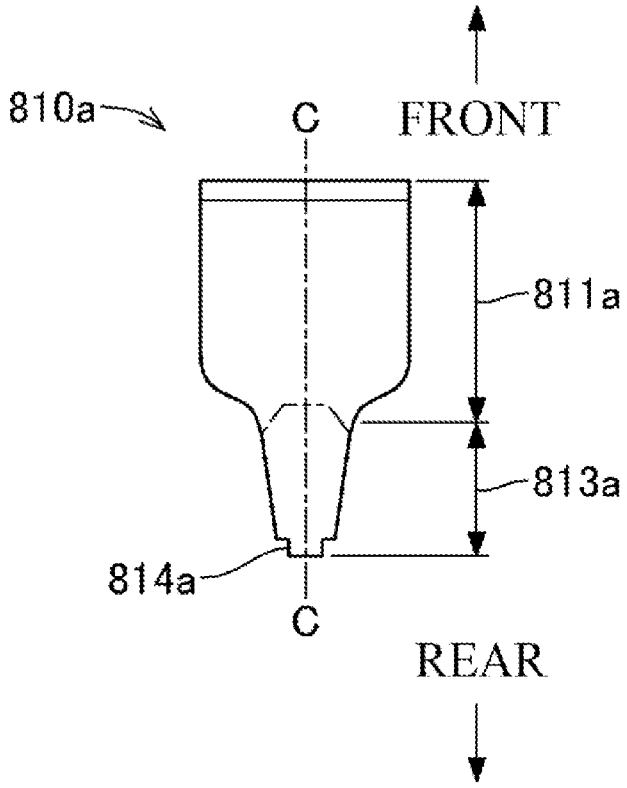
FIG. 5A is an explanatory drawing illustrating a configuration of a carving cutter replaceable blade according to a second embodiment.
Figure 5B:
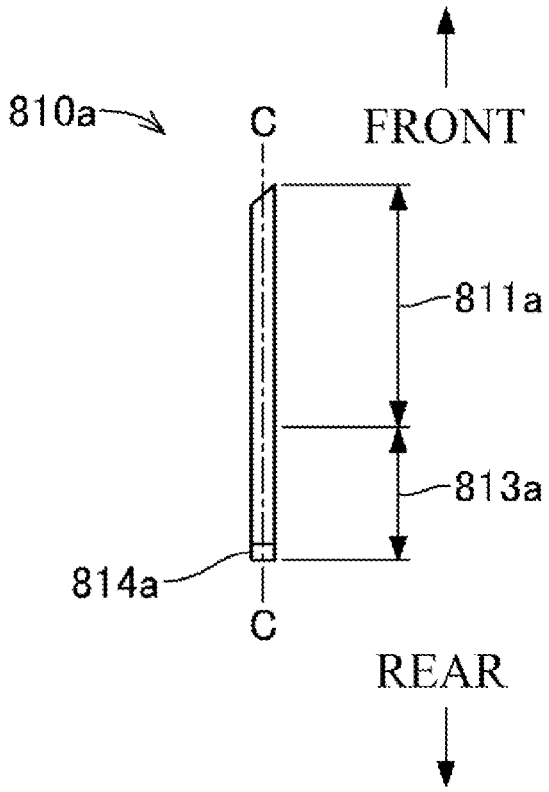
FIG. 5B is an explanatory drawing illustrating a configuration of the carving cutter replaceable blade according to the second embodiment.
Figure 5C:
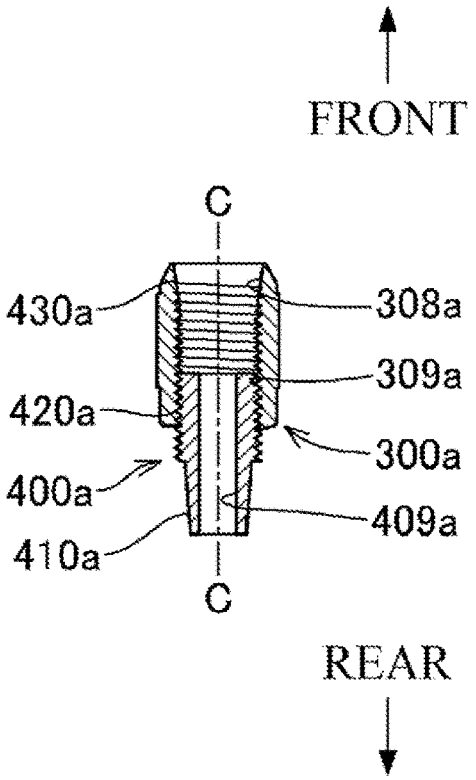
FIG. 5C is an explanatory drawing illustrating respective configurations of a blade holder and a tightening ring.
Figure 5D:
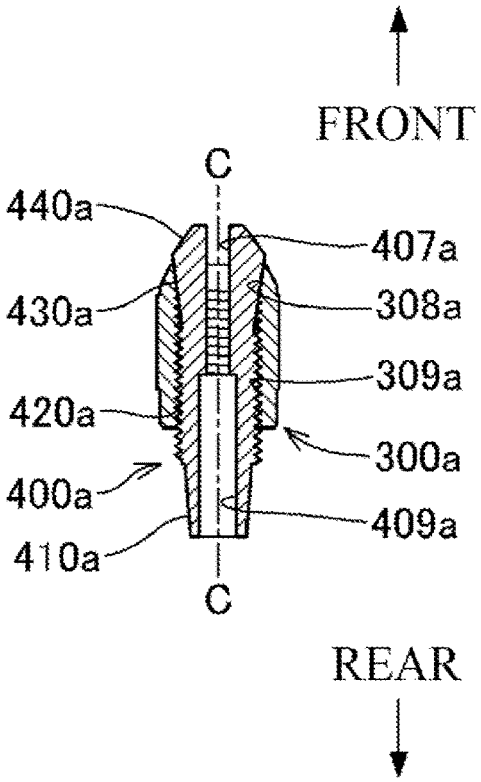
FIG. 5D is an explanatory drawing illustrating respective configurations of the blade holder and the tightening ring.

FIG. 5A and FIG. 5B are explanatory drawings illustrating a configuration of a carving cutter replaceable blade 810*a* mounted on the impact tool according to a second embodiment of the present invention, and FIG. 5C and FIG. 5D are explanatory drawings illustrating respective configurations of a blade holder 400*a* and a tightening ring 300*a* as the blade mounting portion of the blade mounting device. Note that the configuration of the tool mounting portion 100 and the holder coupling portion 200 according to the second embodiment is the same as that of the first embodiment, and therefore, its illustration and description are omitted, and the description for matters shared with the first embodiment is omitted.

FIG. 5A and FIG. 5B illustrate states where the carving cutter replaceable blade 810*a* is viewed from a front face and a side face, respectively. FIG. 5C and FIG. 5D illustrates states where the blade holder 400*a* and the tightening ring 300*a* are in an attached state and are cut off along planar surfaces parallel to projection planes of the FIG. 5A and FIG. 5B through the center axis C, respectively.

As illustrated in FIG. 5A and FIG. 5B, the carving cutter replaceable blade 810*a* is wholly formed into a flat plate shape. This carving cutter replaceable blade 810*a* has a blade 811*a* and a tang 813*a*. As illustrated in FIG. 5A, the tang 813*a* is formed to have a side surface in a shape inclined (an inclined shape) with respect to the center axis C, similarly to the tang 813 in the blade 810 (FIG. 2) in the first embodiment. The tang 813*a* has a protrusion portion 814*a* that is disposed in the rear end side and restricts a rotation of the carving cutter replaceable blade 810*a*.

Note that while the carving cutter replaceable blade 810*a* illustrated in FIG. 5A and FIG. 5B has the blade 811*a* in the flat plate shape, and is wholly formed to be in the flat plate shape, as a carving cutter replaceable blade, it is only necessary to have the tang in the flat plate shape, and for example, one with a blade folded into a V shape or a U shape may be employed.

As can be seen from the description above, while the carving cutter replaceable blade 810*a* does not have the neck 812 unlike the blade 810 (FIG. 2), the carving cutter replaceable blade 810*a* has the blade 811*a* and the tang 813*a* similarly to the blade 810. The carving cutter is also a tool that cuts a workpiece by pushing a cutting edge forward. Therefore, the carving cutter replaceable blade 810*a* can also be referred to as a blade of a pushing cut tool.

As illustrated in FIG. 5C and FIG. 5D, the tightening ring 300*a* is an approximately cylindrically-shaped member having a female screw 309*a* and an inverted tapered hole 308*a*. Note that, in the tightening ring 300*a* according to the second embodiment, the female screw 309*a* is formed over approximately whole rear side to front side, and furthermore, the inverted tapered hole 308*a* having an inner diameter that enlarges as approaching forward is formed in a front end portion of the tightening ring 300*a*.

The blade holder 400*a* has a rear side tapered portion 410*a* that is disposed in a rear side and has an outer diameter reducing as approaching the rear, a male thread portion 420*a* that is disposed in a front side of the rear side tapered portion 410*a* and has a male screw, a front side tapered portion 430*a* that is disposed in a front side of the male thread portion 420*a* and has an outer diameter enlarging as approaching the front, and a projecting portion 440*a* that extends further forward from the front side tapered portion 430*a*.

In the blade holder 400*a*, a center hole 409*a* along the center axis C is provided in the rear side. This center hole

409*a* is provided such that its inner diameter is slightly larger than a width of the protrusion portion 814*a* of the carving cutter replaceable blade 810*a* (FIG. 5A). In the blade holder 400*a*, a slit 407*a* set to have a width as same as a thickness of the carving cutter replaceable blade 810*a* is formed so as to reach the center hole 409*a* from an end surface of the front side.

Inserting the carving cutter replaceable blade 810*a* into this slit 407*a* inserts the protrusion portion 814*a* of the carving cutter replaceable blade 810*a* into the center hole 409*a*. The protrusion portion 814*a* being brought into contact with the inner surface of the center hole 409*a* restricts the rotation of the carving cutter replaceable blade 810*a*.

When the tightening ring 300*a* is rotated and the tightening ring 300*a* moves forward with the carving cutter replaceable blade 810*a* being inserted in the slit 407*a*, the carving cutter replaceable blade 810*a* is sandwiched by the inner surface of the slit 407*a*. This restricts the carving cutter replaceable blade 810*a* from dropping off of the blade holder 400*a*.

Moving the tightening ring 300*a* forward presses the inverted tapered hole 308*a* formed in the tightening ring 300*a* onto a side surface of the tang 813*a* of the carving cutter replaceable blade 810*a* formed into the inclined shape. This causes the impact force applied on the blade mounting device from the impact tool to be transmitted to the carving cutter replaceable blade 810*a* via the inner surface of the inverted tapered hole 308*a* and the side surface of the tang 813*a* in tapered shapes that are inclined shape surfaces complementary to one another. Therefore, the impact force application onto the rear side end surface of the tang 813*a* narrow in width is restricted, thereby ensuring a reduced deformation of the tang 813*a*.

Furthermore, disposing the projecting portion 440*a* in the blade holder 400*a* ensures catching the blade holder 400*a* (projecting portion 440*a*) with the blade 811*a* having a wide width as indicated by a two-dot chain line in FIG. 5A. Therefore, bending of the carving cutter replaceable blade 810*a* in the tang 813*a* narrow in width or a breakage of the carving cutter replaceable blade 810*a* in the front side of the tang 813*a* is restricted.

C. Third Embodiment

Figure 6A:
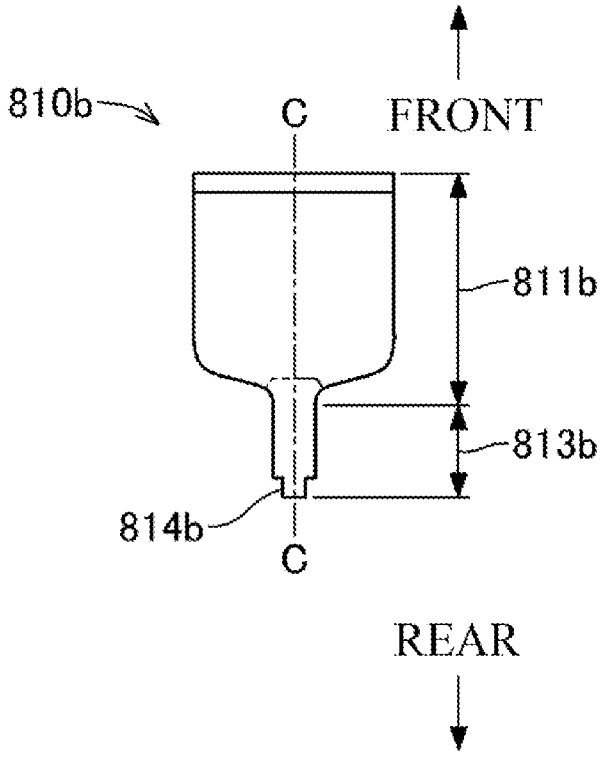
FIG. 6A is an explanatory drawing illustrating a configuration of a carving cutter replaceable blade according to a third embodiment.
Figure 6B:
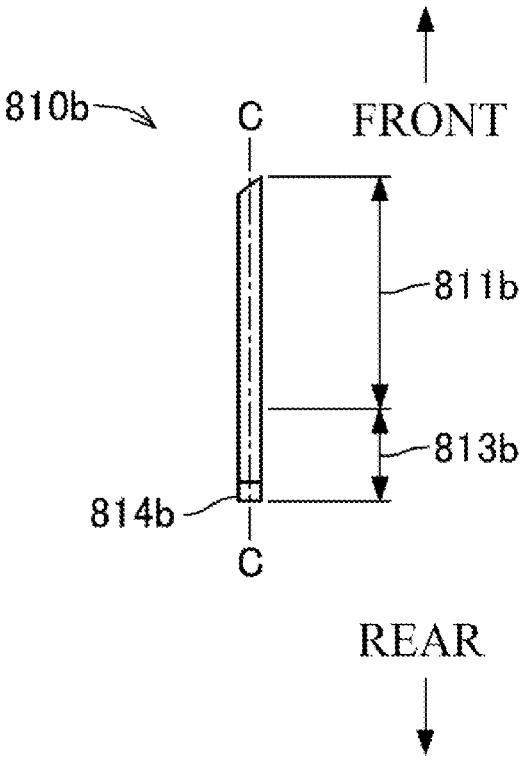
FIG. 6B is an explanatory drawing illustrating a configuration of the carving cutter replaceable blade according to the third embodiment.
Figure 6C:
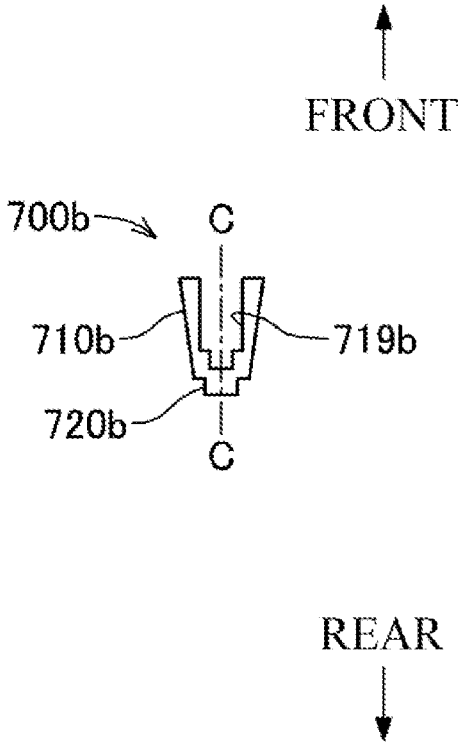
FIG. 6C is an explanatory drawing illustrating a configuration of an adapter for mounting the carving cutter replaceable blade on the blade mounting device.
Figure 6D:
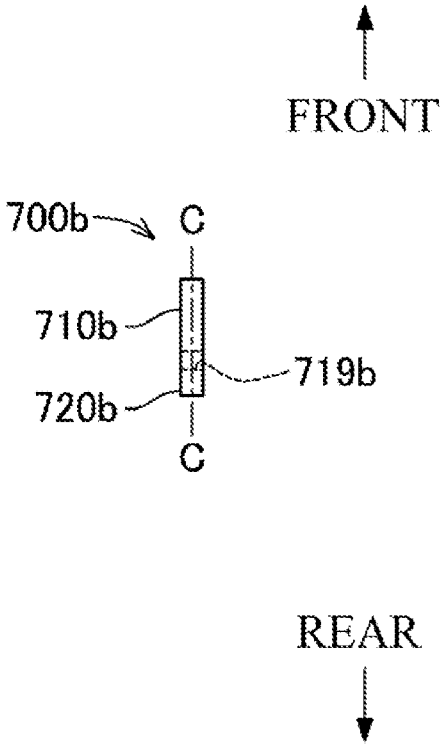
FIG. 6D is an explanatory drawing illustrating a configuration of the adapter for mounting the carving cutter replaceable blade on the blade mounting device.

FIG. 6A and FIG. 6B are explanatory drawings illustrating a configuration of a carving cutter replaceable blade 810*b* according to a third embodiment of the present invention that is mounted on the impact tool and has a shape different from that of the carving cutter replaceable blade 810*a* (FIG. 5A and FIG. 5B) according to the second embodiment, and FIG. 6C and FIG. 6D are explanatory drawings illustrating respective configurations with an adapter 700*b* for mounting this carving cutter replaceable blade 810*b* on the blade mounting device. Note that the configuration of the blade holder 400*a* and the tightening ring 300*a* (the blade mounting portion) according to the third embodiment is the same as that of the second embodiment, and therefore, its illustration and description are omitted, and the description for matters shared with the second embodiment is omitted.

FIG. 6A and FIG. 6B illustrate states where the carving cutter replaceable blade 810*b* is viewed from a front face and a side face, respectively. FIG. 6C and FIG. 6D illustrate states where the adapter 700*b* is viewed from a front face and a side face, respectively.

As illustrated in FIG. 6A and FIG. 6B, the carving cutter replaceable blade 810*b* is wholly formed into a flat plate shape, similarly to the carving cutter replaceable blade 810*a* in the second embodiment. This carving cutter replaceable blade 810*b* also has a blade 811*b* and a tang 813*b* that has a protrusion portion 814*b*.

As illustrated in FIG. 6A, the tang 813*b* of the carving cutter replaceable blade 810*b* is a carving cutter replaceable blade put on a market as a replaceable blade of a general electric carving machine, and is formed to have a width narrower and a length shorter than that of the carving cutter replaceable blade 810*a* in the second embodiment. The tang 813*b* has a side surface in an approximately rectangular plate shape formed in parallel with the center axis C.

As illustrated in FIG. 6C and FIG. 6D, the adapter 700*b* is a member having the same thickness as the carving cutter replaceable blade 810*b*, and has a replaceable blade housing portion 710*b* and a protrusion portion 720*b*. The replaceable blade housing portion 710*b* has a side surface formed into an inclined shape that inclines with respect to the center axis C. The replaceable blade housing portion 710*b* has a front side where a depressed portion 719*b* formed into a shape complementary to the tang 813*b* is formed.

Housing the tang 813*b* of the carving cutter replaceable blade 810*b* in this depressed portion 719*b* and inserting the adapter 700*b* and the tang 813*b* together in the slit 407*a* of the blade holder 400*a* (FIG. 5C and FIG. 5D) ensure mounting the carving cutter replaceable blade 810*b* of the third embodiment in the blade mounting device similarly to the carving cutter replaceable blade 810*a* of the second embodiment.

Disposing the projecting portion 440*a* in the blade holder 400*a* ensures engaging the blade holder 400*a* (projecting portion 440*a*) with the blade 811*b* having a wide width as indicated by a two-dot chain line in FIG. 6A. Therefore, bending of the carving cutter replaceable blade 810*b* in the tang 813*a* narrow in width or a breakage of the carving cutter replaceable blade 810*b* in the front side of the tang 813*a* is restricted.

Note that, in the third embodiment, the inclined shape surface complementary to the inverted tapered hole 308*a* provided in the tightening ring 300*a* (FIG. 5C and FIG. 5D) is formed only on the adapter 700*b*. Therefore, the carving cutter replaceable blade 810*b* and the adapter 700*b* are possible to be regarded as a blade having this inclined shape surface together.

D. Fourth Embodiment

Figure 7A:
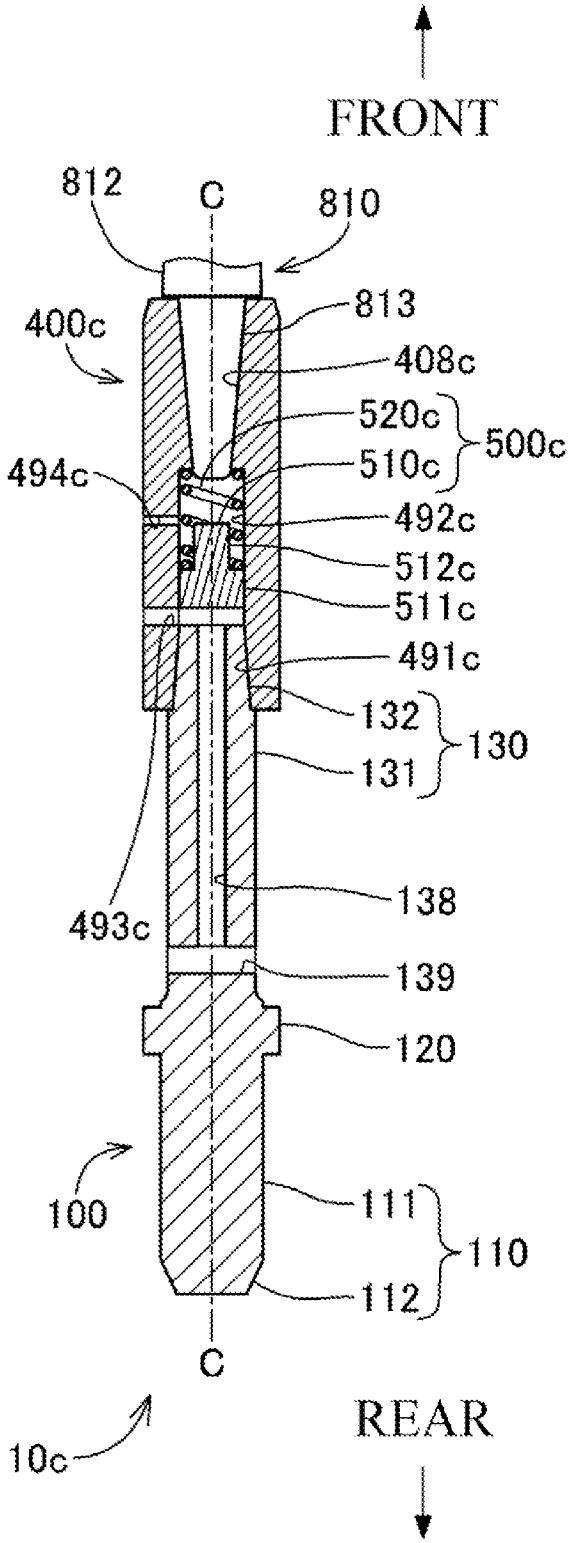
FIG. 7A is an explanatory drawing illustrating a state where the blade of the chisel is removed from the blade mounting device according to a fourth embodiment.
Figure 7B:
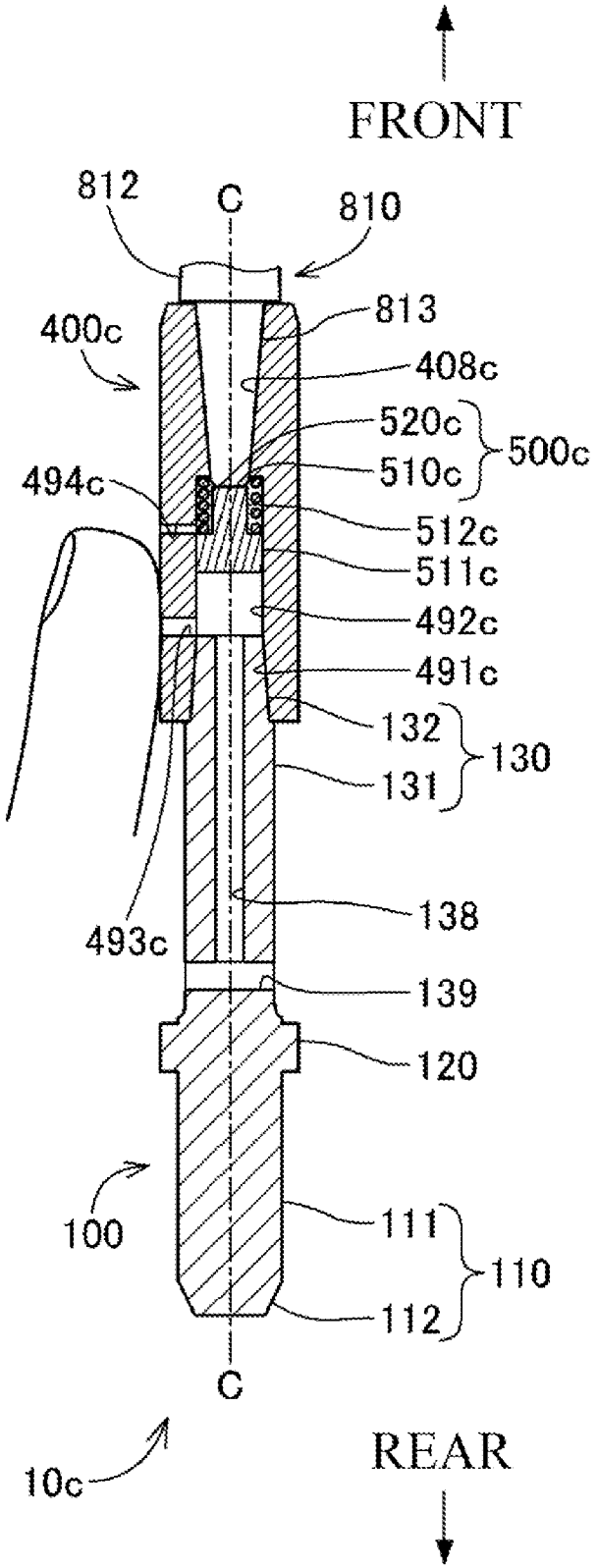
FIG. 7B is an explanatory drawing illustrating a state where the blade of the chisel is being removed from the blade mounting device according to the fourth embodiment.

FIG. 7A and FIG. 7B are explanatory drawings illustrating a state where the blade 810 of the chisel is being removed from a blade mounting device 10*c* according to a fourth embodiment. FIG. 7A illustrates a state where the blade 810 is mounted on the blade mounting device 10*c*, and FIG. 7B illustrates a movement when the blade 810 is being removed from the blade mounting device 10*c*.

Note that the blade mounting device 10*c* according to the fourth embodiment is different from the blade mounting device 10 of the first embodiment in that the configuration of a blade holder 400*c* is different, that the holder coupling portion 200 and the tightening ring 300 are omitted, and that a knocker 500*c* for removing the blade 810 is added. Other aspects are similar to the first embodiment, and the description for matters shared with the first embodiment is omitted. Note that, since the tightening ring 300 is omitted in the blade mounting device 10*c* of the fourth embodiment, the blade holder 400*c* corresponds to the blade mounting portion.

As illustrated in FIG. 7A, the blade holder 400*c* in the fourth embodiment is an approximately cylindrically-shaped member. In the blade holder 400*c*, a rear side inverted tapered hole 491*c* having an inner diameter that enlarges as approaching the rear, a center hole 492*c* along the center axis C, and a front side inverted tapered hole 408*c* having an inner diameter that enlarges as approaching the front are formed in this order from the rear side to the front side. Note that the inner diameter in the front end of the front side inverted tapered hole 408*c* is unlike the inverted tapered hole 408 formed in the blade holder 400 of the first embodiment, and is set to be slightly smaller than the outer diameter of the forward end of the tang 813. Therefore, even in the fourth embodiment, the transmission of the impact force to the tang 813 from the blade holder 400*c* is performed via the front side inverted tapered hole 408*c* and the inclined shape surface of the tang 813.

The blade holder 400*c* has a rear end portion of the center hole 492*c* and an approximately center portion of the center hole 492*c* where an air discharge hole 493*c* that is perpendicular to the center axis C and reaches the center hole 492*c* from an outer surface of the blade holder 400*c* and an air vent hole 494*c* having an inner diameter smaller than that of the air discharge hole 493*c* are respectively provided. Note that the inner diameter of the air vent hole 494*c* does not necessarily have to be smaller than the inner diameter of the air discharge hole 493*c*.

The knocker 500*c* has a knocker main body 510*c* that has a large diameter portion 511*c* and a small diameter portion 512*c* in column shapes and a spring 520*c*. The large diameter portion 511*c* has an outer diameter set to be approximately the same as the inner diameter of the center hole 492*c* of the blade holder 400*c*, and the small diameter portion 512*c* has an outer diameter set to be slightly smaller than the inner diameter of the spring 520*c*. The spring 520*c* and the knocker main body 510*c* are housed in the center hole 492*c* in this order. Note that since the center hole 492*c* is thus configured to house the knocker 500*c*, it can be referred to as a knocker housing hole.

As can be seen from FIG. 7A, the inner diameter of the center hole 492*c* of the blade holder 400*c* is the same as the inner diameter of the front end of the rear side inverted tapered hole 491*c*, and is larger than the inner diameter of the rear end of the front side inverted tapered hole 408*c*. Therefore, the spring 520*c* is brought into contact with the front side end surface of the center hole 492*c* and the front side end surface of the large diameter portion 511*c* of the knocker main body 510*c*.

The spring 520*c* is adjusted to be in contact with the front side end surface of the center hole 492*c* and the front side end surface of the large diameter portion 511*c* in a natural length in a state where the rear side end surface of the large diameter portion 511*c* is positioned at the front end of the air discharge hole 493*c*. That is, the air discharge hole 493*c* has the large diameter portion 511*c* (the knocker main body 510*c*) arranged to be positioned forward with respect to the air discharge hole 493*c* when the spring 520*c* is brought into contact with both the center hole 492*c* and the large diameter portion 511*c* in the natural length. Therefore, the compressed air supplied via the through hole 139 and the center hole 138 provided in the shaft portion 130 of the tool mounting portion 100 is discharged to the outside through the air discharge hole 493*c*.

As illustrated in FIG. 7B, when this air discharge hole 493*c* is covered with a finger or the like, the knocker main body 510*c* is pressed forward by the pressure of the supplied compressed air. At this time, the air in a space formed by the knocker main body 510*c*, the center hole 492*c*, and the tang 813 of the blade 810 is released to the outside through the air vent hole 494*c* provided in a front with respect to the air discharge hole 493*c*, thereby moving the knocker main body 510*c* forward at a sufficiently fast speed. Then, a forward impact from the small diameter portion 512*c* to the tang 813 is applied. The tang 813 thus being hammered forward loosens the security between the tang 813 and the front side inverted tapered hole 408*c*, thereby facilitating the removal of the blade 810 from the blade mounting device 10*c*.

Note that, while in the fourth embodiment, the tang 813 meshes with the front side inverted tapered hole 408*c* in a secured shape, a tightening ring may be added and a slit may be provided in the blade holder, and the tang may mesh in a state where the slit is closed, similarly to the first embodiment. For example, when the blade mounting device has a configuration similar to that of the blade mounting device 10 of the first embodiment, the air discharge hole is simply provided in the holder coupling portion and the air vent hole is simply provided in the male thread portion. Note that, in this case, the air vent hole is preferred to be smaller than the air discharge hole in order to make the rotation of the tightening ring smoother.

E. Modification

The present invention is not limited to each of the embodiments described above, but can be implemented in various aspects without departing from the gist of the invention. For example, the following modifications can be made.

E1. Modification 1:

While in each of the embodiments described above, the blade mounting devices 10 and 10*c* are mounted on the impact tool 900 of a pneumatic pressure type as illustrated in FIG. 3, the blade mounting device of the present invention may be mounted on an impact tool of the pneumatic pressure type having a different configuration or an impact tool of an electricity driven type. Even in these cases, a shape of the tool mounting portion can be variously changed corresponding to the configuration of the impact tool as long as the tool mounting portion is provided with a through hole perpendicular to the center axis and a center hole that reaches the through hole from the front side end surface of the tool mounting portion along the center axis.

In particular, when no compressed air is supplied in, for example, an electricity driven type impact tool, it is configured such that an air is directly supplied to the through hole provided on the tool mounting portion. Therefore, the through hole does not necessarily have to be provided in the rear end portion of the shaft portion.

E2. Modification 2:

While in the above-described first to third embodiments, the tool mounting portion 100 and the blade holders 400 and 400*a* are secured using the holder coupling portion 200, the tool mounting portion may be directly secured to the blade holder without using the holder coupling portion as in the fourth embodiment. Generally, other members can be added or omitted as necessary as long as the blade mounting device has a tool mounting portion for mounting the blade mounting device on the impact tool and a blade mounting portion for mounting the blade on the blade mounting device.

E3. Modification 3:

While in each of the above-described embodiments, combinations of the two members (the tool mounting portion 100 and the holder coupling portion 200, the tool mounting portion 100 and the blade holder 400*c*, and the holder coupling portion 200 and the blade holders 400 and 400*c*) that are securely mounted to one another in the blade mounting devices 10 and 10*c* to transmit the impact force are secured by meshing the complementarily tapered surfaces, these combinations of the members may be secured using screws and the like. However, in that the damage of the blade mounting device caused by the impact force applied from the impact tool can be reduced, the combinations of the two members that are securely mounted to one another to transmit the impact force are preferred to be secured by meshing the complementarily tapered surfaces.

INDUSTRIAL APPLICABILITY

With this invention, a blade of a pushing cut tool, such as a carving cutter and a chisel, can be mounted on an impact tool including a breaker and a hammer chisel to cut a workpiece, thereby ensuring an appropriate application for making large-sized carvings including statues of Buddha and decorations for temples and shrines.

DESCRIPTION OF REFERENCE SIGNS

10, 10*c* . . . Blade mounting device
100 . . . Tool mounting portion
110 . . . Base end portion
111 . . . Columnar portion
112 . . . Tapered portion
120 . . . Collar portion
130 . . . Shaft portion
131 . . . Shaft main portion
132 . . . Tapered portion
135 . . . Plane surface portion
138 . . . Center hole
139 . . . Through hole
200 . . . Holder coupling portion
208 . . . Front side inverted tapered hole
209 . . . Rear side inverted tapered hole
300, 300*a* . . . Tightening ring
308, 308*a* . . . Inverted tapered hole
309, 309*a* . . . Female screw
400, 400*a*, 400*c* . . . Blade holder
407, 407*a* . . . Slit
408 . . . Inverted tapered hole
408*c* . . . Front side inverted tapered hole
409, 409*a* . . . Center hole
410, 410*a* . . . Rear side tapered portion
420, 420*a* . . . Male thread portion
429 . . . Through hole
430, 430*a* . . . Front side tapered portion
440*a* . . . Projecting portion
491*c* . . . Rear side inverted tapered hole
492*c* . . . Center hole
493*c* . . . Air discharge hole
494*c* . . . Air vent hole
500*c* . . . Knocker
510*c* . . . Knocker main body
511*c* . . . Large diameter portion
512*c* . . . Small diameter portion
520*c* . . . Spring
700*b* . . . Adapter
710*b* . . . Replaceable blade housing portion
719*b* . . . Depressed portion
720*b* . . . Protrusion portion
800 . . . Chisel
810 . . . Blade
810*a*, 810*b* . . . Carving cutter replaceable blade
811, 811*a*, 811*b* . . . Blade
812 . . . Neck
813, 813*a*, 813*b* . . . Tang
814*a*, 814*b* . . . Protrusion portion
820 . . . Ferrule
821 . . . Ring-shaped portion
822 . . . Tapered portion
827, 837 . . . Through hole
828 . . . Inverted tapered hole
829 . . . Center hole
830 . . . Handle
839 . . . Inverted tapered hole
840 . . . Steel hoop
900 . . . Impact tool
910 . . . Piston
920 . . . Cylinder
930 . . . Cap
939 . . . Through hole
940 . . . Spring
AF . . . Front end space
C . . . Center axis

The invention claimed is:

1. A blade mounting device for mounting a blade of a pushing cut tool that cuts a workpiece by pushing a cutting edge forward on an impact tool, the blade mounting device comprising:

a blade mounting portion configured to mount the blade on the blade mounting device; and a tool mounting portion that is secured to the blade mounting portion and configured to mount the blade mounting device on the impact tool, wherein the blade mounting portion has a front end portion where an inverted tapered hole is formed to be complementary to an inclined shape surface formed on a tang of the blade, the tool mounting portion is provided with a through hole perpendicular to a center axis of the tool mounting portion and a center hole that reaches the through hole from a front side end surface of the tool mounting portion along the center axis, the blade mounting device is configured such that an impact force applied from the impact tool to the blade mounting device is transmitted to the blade via an inner surface of the inverted tapered hole and the inclined shape surface, and the blade mounting device further comprises a knocker including a knocker main body and a spring, the knocker being configured to allow hammering the tang forward, wherein the blade mounting device is configured to mount a blade of a chisel as the blade, the blade mounting portion is provided with a knocker housing hole that houses the spring and the knocker main body along the center axis of the blade mounting portion so that the spring and the knocker main body can be ordered in either direction along the center axis, and an air discharge hole and an air vent hole perpendicular to the center axis to reach the knocker housing hole from an outer surface of the blade mounting portion, the blade mounting portion being provided with the inverted tapered hole in a front side of the knocker housing hole, the knocker housing hole has an inner diameter set to be larger than an inner diameter of a rear side end of the inverted tapered hole, the knocker main body has a large diameter portion set to have an outer diameter identical to the inner diameter of the knocker housing hole and a small diameter portion disposed in a front side of the large diameter portion, the small diameter portion having an outer diameter smaller than an inner diameter of the spring, the air discharge hole is provided such that the large diameter portion is positioned in a front with respect to the air discharge hole when the spring is brought into contact with both a side end surface of the knocker housing hole and the large diameter portion in a length, and the air vent hole is provided in a front with respect to the air discharge hole.

2. The blade mounting device according to claim 1, wherein the inclined shape surface and the inverted tapered hole have an inclined angle set to be in a range of 4° to 6°.

3. The blade mounting device according to claim 1, wherein a combination of the tool mounting portion and the tang of the blade, which are securely mounted on one another to transmit the impact force in the blade mounting device, is secured by meshing the inverted tapered hole of the blade mounting portion and the inclined shape surface of the tang of the blade.

* * * * *